United States Patent [19]

Brociner

[11] 3,995,817

[45] Dec. 7, 1976

[54] COMMINUTION OF SOLIDS

[75] Inventor: Ronald Eric Brociner, St. Austell, England

[73] Assignee: English Clays Lovering Pochin & Company Limited, St. Austell, England

[22] Filed: Sept. 17, 1975

[21] Appl. No.: 614,249

[30] Foreign Application Priority Data

Sept. 17, 1974 United Kingdom ..... 40551/74

[52] U.S. Cl. ..... 241/30; 241/34; 241/46.17

[51] Int. Cl.[2] ..... B02C 23/36

[58] Field of Search ..... 241/30, 33, 34, 35, 241/46.08, 46.11, 46.15, 46.17

[56] References Cited

UNITED STATES PATENTS

| | | | |
|---|---|---|---|
| 2,764,359 | 9/1956 | Szeguari | 241/46.17 |
| 2,843,327 | 7/1958 | Nickle | 241/35 |
| 3,050,263 | 8/1962 | Barkman et al. | 241/46.17 |
| 3,298,618 | 1/1967 | Talpey | 241/46.17 |
| 3,528,616 | 9/1970 | Krolopp et al. | 241/34 |
| 3,604,634 | 9/1971 | Windle | 241/30 |

*Primary Examiner*—Granville Y. Custer, Jr.
*Attorney, Agent, or Firm*—Browdy and Neimark

[57] ABSTRACT

There is disclosed a process and an apparatus for comminuting solids wherein an attrition-grinding mill includes a grinding chamber having an inlet means enabling a feed slurry of a particulate solid to be comminuted to be introduced into the grinding chamber and an outlet means including a sieve for allowing therethrough a ground product slurry whilst retaining a granular grinding medium within the grinding chamber, the sieve being disposed below the surface of the contents of the grinding chamber and wherein there are first control means associated with the inlet means and/or with the outlet means of the attrition-grinding mill for controlling the relative volume flow rates of said feed slurry and said ground product slurry, and second control means associated with the outlet means of said attrition-grinding mill and responsive to changes in the volume ratio of granular grinding medium to slurry in the grinding chamber for stopping or starting the flow of ground product slurry through said outlet means.

21 Claims, 8 Drawing Figures

COMMINUTION OF SOLIDS

BACKGROUND OF THE INVENTION

This invention relates to the comminution of solid materials and, more particularly, is concerned with an apparatus and a process for the attrition-grinding of particulate solids.

The comminution of particulate solids by attrition-grinding grinding has been well known since about 1948 and essentially comprises the agitation of a mixure comprising a slurry of the particulate solid to be comminuted and a granular grinding medium. This method of comminuting solids is generally used when it is desired to reduce a particulate solid to particles of very small size, for example to particles substantially all of which are smaller than 53 microns (i.e. they will pass through a No. 300 mesh B.S. sieve).

Several designs of attrition-grinding mills for carrying out an attrition-grinding process have been suggested, but at the present time the attrition-grinding mills used on a commercial scale are generally constructed so that a feed slurry of the particulate solid to be comminuted can be fed as a continuous stream to the mill at the bottom of an upright grinding chamber and the ground product slurry can overflow continuously through a sieve at the top of the grinding chamber, the sieve having apertures of a size such that the granular grinding medium is retained in the grinding chamber. It may be noted here that the particulate solid in the feed slurry will consist predominantly of particles substantially smaller than the apertures in the sieve, and that the purpose of the sieve is to retain the grinding medium in the grinding chamber and not to determine the particle size of the solids in the ground product slurry.

When the product is to be transported as a slurry it is desirable to work with the feed slurry at as high a solids content as possible, but it is found that if a feed slurry of high solids content is subjected to prolonged grinding in an attrition-grinding mill constructed as described above, considerable heat is generated and the sieve tends to become blinded through the evaporation of the liquid of the slurry and the deposition of solids in the apertures of the sieve. It is also found that there is a tendency for the concentration of the granular grinding medium to be highest in the upper part of the grinding chamber which means that the ratio of granular grinding medium to feed slurry varies over the height of the grinding chamber; this may by disadvantageous in some types of attrition-grinding mill. A further disadvantage is that an attrition-grinding mill in which the ground product slurry continuously leaves the grinding chamber there is a tendency for the flow of ground product slurry through a sieve to decrease steadily as the grinding process since the slurry carries particles of the granular grinding medium with it and causes them to lodge in the apertures of the sieve thus restricting the flow. Since the ratio of granular grinding medium to slurry is important in determining the optimum grinding efficiency, any variation in the flow of ground product slurry from the grinding chamber, without a corresponding change in the flow of feed slurry to the grinding chamber, may eventually have an adverse effect on the efficiency of the process.

SUMMARY OF THE INVENTION

According to one aspect of the invention there is provided an apparatus for use in comminuting particulate solids which apparatus comprises (a) attrition-grinding mill including a grinding chamber provided with an internal, rotatable impeller for agitating the contents of the grinding chamber, a motor for driving the impeller, inlet means enabling a feed slurry of particulate solids to be comminuted to be introduced into the grinding chamber, and outlet means including a sieve for allowing therethrough ground product slurry whilst retaining the granular grinding medium within the grinding chamber, the sieve being disposed at a position such that, when the apparatus is in use, the sieve is below the surface of a mixture of granular grinding medium and slurry in the grinding chamber, (b) first control means associated with the inlet means and/or with the outlet means of said attrition-grinding mill for controlling the relative volume flow rates of said feed slurry and said ground product slurry, and (c) second control means associated with the outlet means of said attrition-grinding mill and responsive to changes in the volume ratio of granular grinding medium to slurry in the grinding chamber for stopping or starting the flow of ground product slurry through said outlet means.

According to another aspect of the present invention there is provided a process for comminuting solid particles which process comprises the steps of (a) charging to a grinding chamber of an attrition-grinding mill a quantity of a granular grinding medium and a quantity of a feed slurry of a particulate solid to be comminuted to form a mixture, the quantities of granular grinding medium and feed slurry being such that the volume ratio of granular grinding medium to slurry in the grinding chamber is in the range 0.5:1 to 1.5:1, (b) agitating the mixture of feed slurry and granular grinding medium, (c) admitting further quantities of feed slurry to the grinding chamber whilst withdrawing ground product slurry from the grinding chamber through a sieve provided therein below the surface of said mixture, the relative volume flow rates of feed slurry and ground product slurry being controlled so that the volume ratio of granular grinding medium to slurry in the grinding chamber increases, and (d) interrupting the withdrawl of ground product slurry from the grinding chamber when said volume ratio exceeds a first perdetermined value and restarting the withdrawal of ground product slurry when said volume ratio has fallen to a second predetermined value.

By withdrawing the ground product slurry intermittently (whilst continuing to introduce the feed slurry), there occur periods during which there is no flow through the sieve which, being below the surface of the mixture in the grinding chamber, is thereby cleaned by the mechanical action of the mixture in the grindig chamber. During the period when the ground product slurry is being withdrawn from the grinding chamber it is withdrawn at a faster rate than the feed slurry is being introduced to the grinding chamber so that the total volume of material in the grinding chamber decreases and the volume ratio of granular grinding medium to slurry increases. During this step, the rate of withdrawal of ground product slurry is preferably about twice the rate of introduction of feed slurry into the grinding chamber. However, when the withdrawal of the ground product slurry is interrupted the total volume of material in the grinding chamber increases and the volume ratio of granular grinding medium to slurry decreases.

The change in the volume ratio of granular grinding medium to slurry affects the viscosity of the mixture in the grinding chamber and thus enables the volume ratio of the granular grinding medium to slurry to be monitored so that the withdrawal of the ground product slurry can be interrupted and restarted when the volume ratio of granular grinding medium to slurry rises and falls, respectively, to predetermined levels.

The granular grinding medium is selected according to the nature of the particulate solid to be comminuted, but can be defined as a granular solid material consisting of granules larger than the apertures in the sieve. In general, it has been found that good results can be achieved if the mean size of the granules of the granular grinding medium is in the range of from 8 to 12, preferably about ten, times the mean size of the particles of the particulate solid to be comminuted. Conveniently, the granular grinding medium consists of granules having diameters in the range 0.15 mm to 20.0 mm, preferably in the range 0.5 mm to 2.0 mm. The granular grinding medium can be made of a mineral, ceramic, metallic or plastics material and whilst usually of a different material from that of the particular solid material to be comminuted it may be of the same material. Silica sand consisting of granules of substantially spherical shape has been found to be convenient since it is readily obtainable and relatively cheap. Preferably, the volume ratio of granular grinding medium to feed slurry in step (a) of the process of the invention is such that the ratio of the volumes thereof is in the range 0.9:1 to 1.1:1.

The sieve in the grinding chamber is conveniently selected so that the apertures therein are not larger than half the size of the smallest particles in the granular grinding medium at the start of the process. For example, if the granular grinding medium initially consists of particles ranging in size from ¼ inch to ⅜ inch, the aperture size of the sieve will be not greater than 1/8 inch.

The grinding chamber of the attrition-grinding mill preferably has the shape of a cylinder or a right prism which, for example, may have a polygonal cross-section; such a grinding chamber is preferably arranged upright, i.e. with its axis vertical or substantially vertical. The inner walls of the grinding chamber are preferably coated with a resilient material which may conveniently be a natural or synthetic rubber, for example a polyurethane elastomer. The grinding chamber is preferably provided with baffles to inhibit the formation of a vortex. The baffles are conveniently disposes so that they are symmetrical about a diameter of the cross section of the grinding chamber.

The internal rotatable impeller preferably comprises a shaft which advantageously is arranged with its axis parallel to that of the grinding chamber and to which there are secured at the lower end, so as to extend outwardly from the axis of the shaft, from two to 16 bars. The bars of the impeller are advantageously surface hardened, for example by forming on their surface a layer of tungsten carbide; alternatively, they are advantageously encased in sleeves of a natural or synthetic rubber. Preferably, the bars of the impeller are screwed into tapped sockets in the lower part of the shaft so that they may readily be removed and replaced. In operation, such an impeller is preferably rotated so that the peripheral speed of the bars is in the range of from 4 to 20 meters per second. In a preferred embodiment of the invention the sieve of the outlet is disposed opposite the tip of the impeller bars and the latter are preferably constructed so that the distance between the tips of the impeller bars and the sieve is in the range 40 to 400 mm.

Tests were conducted on three different attrition-grinding mills constructed in accordance with this invention to determine the optimum distance between the tips of the impeller bars and the sieve so that adequate washing of the sieve occurred during the period when there was no flow through the sieve. The results obtained are given in Table 1 below:

Table 1

| Rotational speed of impeller (r.p.m.) | Diameter of impeller (m.) | Peripheral speed (m.sec.$^{-1}$) | Distance between blade tips and sieve (mm.) |
|---|---|---|---|
| 120 | 1.26 | 10.2 | 114 |
| 150 | 1.422 | 11.2 | 203 |
| 175 | 1.117 | 10.2 | 356 |

When the grinding chamber is provided with baffles and, together with the impeller, is disposed upright with the shaft of the impeller being provided with a number of bars at the lower end thereof, the baffles will be disposed in that part of the grinding chamber above the impeller bars. Wear on the baffles and impeller bars may be equalized by disposing the baffles so that they are symmetrical about a diameter of the cross-section of the grinding chamber and by reversing the direction of rotation of the impeller at intervals.

The motor employed to drive the impeller is preferably an electric motor.

The inlet means of the attrition-grinding mill is advantageously constructed so that the feed slurry is supplied through a valve from a tank in which there is maintained a constant hydrostatic head of the slurry. With such an arrangement the volume rate of feed slurry can be readily maintained constant.

The outlet means of the attrition-grinding mill is preferably disposed at the lower part of the grinding chamber, most preferably in a side wall thereof. The sieve included in the outlet means is conveniently of the wedge wire type, the wires being provided with protuberances at intervals of from 15 to 40 mm. to prevent adjacent wires from being forced apart by coarse solid particles.

The first control means associated with the inlet means and/or the outlet means of the attrition-grinding mill can take the form of valves provided in inlet and outlet conduits.

The second control means associated with the outlet means of the attrition-grinding mill and responsive to changes in the volume ratio of granular grinding medium to slurry in the grinding chamber can comprise an on/off valve associated with the outlet means, sensing means for sensing a change in the volume ratio of granular grinding medium to slurry in the grinding chamber and producing a signal which is a function of said change, and actuating means responsive to said signal for operating said on/off valve. Advantageously, the sensing means is adapted to sense the change in the volume ratio of granular grinding medium to slurry in the grinding chamber indirectly. Thus, for example, it may sense the load on an electric motor driving the impeller since a change in the volume of the granular grinding medium to slurry produces a corresponding change in the viscosity of the mixture in the grinding chamber which in turn will produce a corresponding change in the load on an electric motor driving the impeller. The load on the electric motor can be monitored by sensing means which sense the current supplied to the motor and produce a signal proportional to that current.

For a better understanding of the invention and to show how the same may be carried into effect reference will now be made, by way of example, to the accompanying drawings in which.

Figure 1:
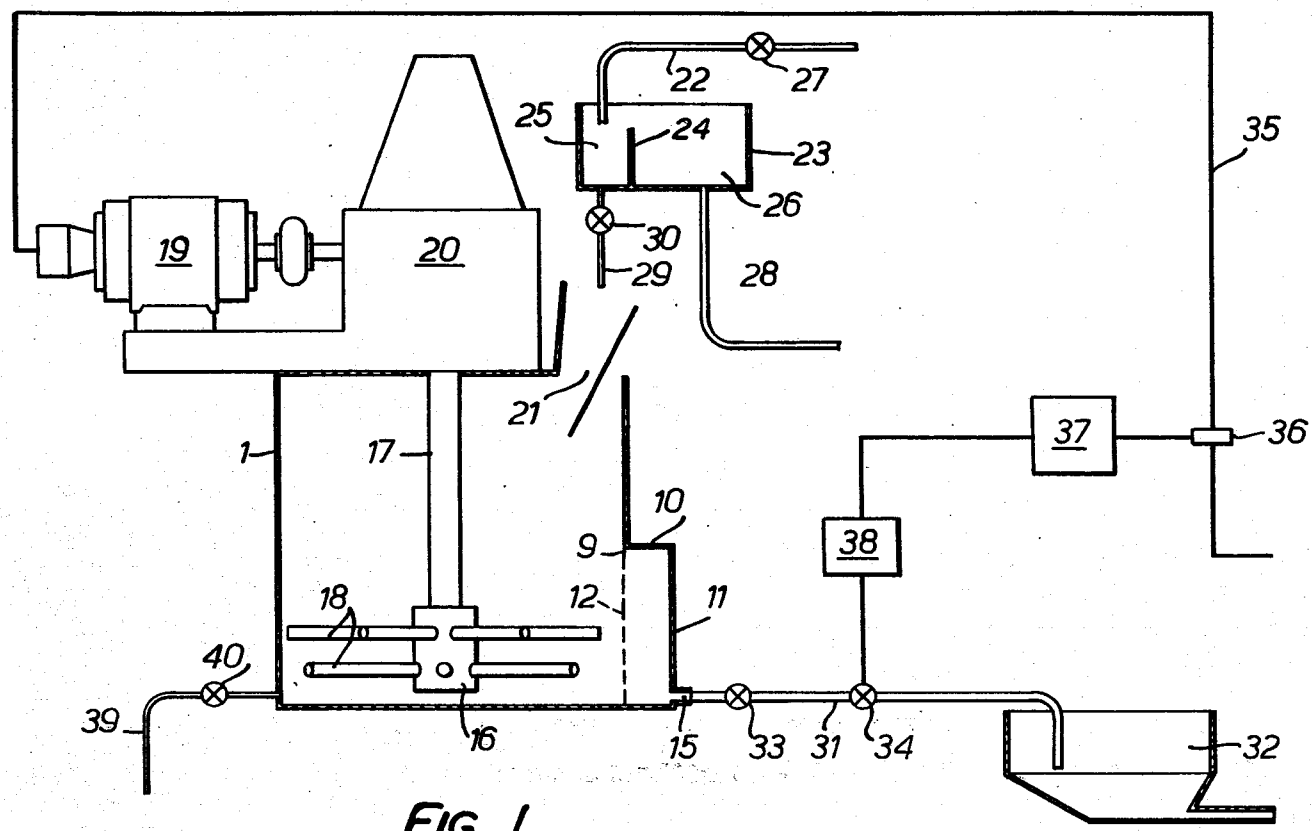
FIG. 1 shows the general arrangement of one embodiment of an apparatus of the invention.
Figure 2:
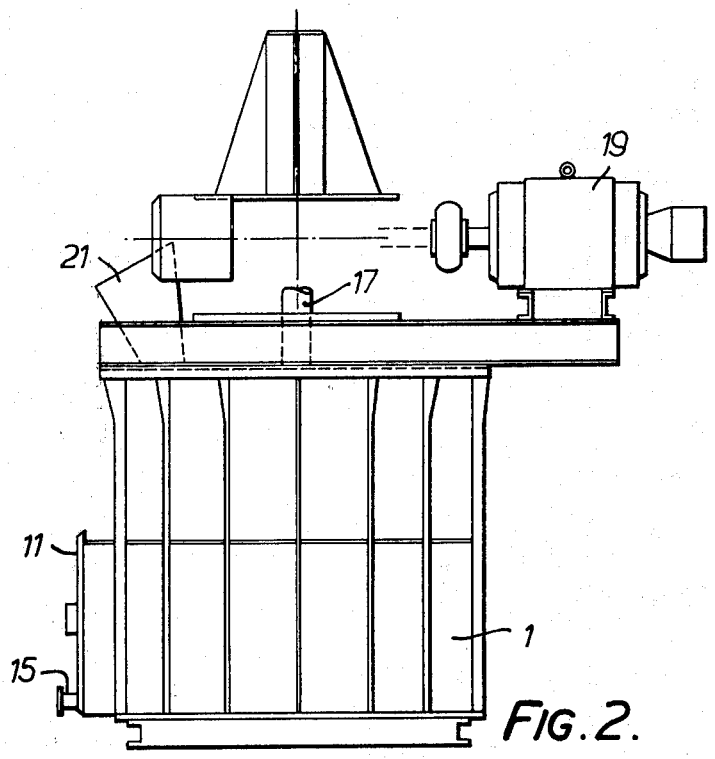
FIG. 2 is an elevation of the attrition-grinding mill of the apparatus shown in FIG. 1.
Figure 3:
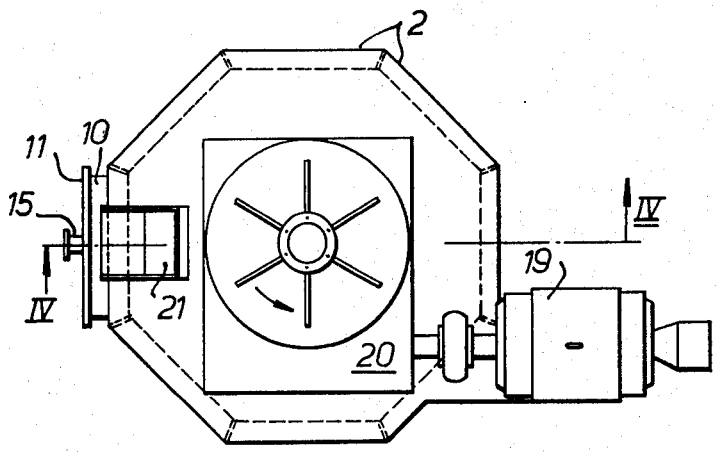
FIG. 3 is a plan view of the attrition-grinding mill shown in FIG. 2.
Figure 4:
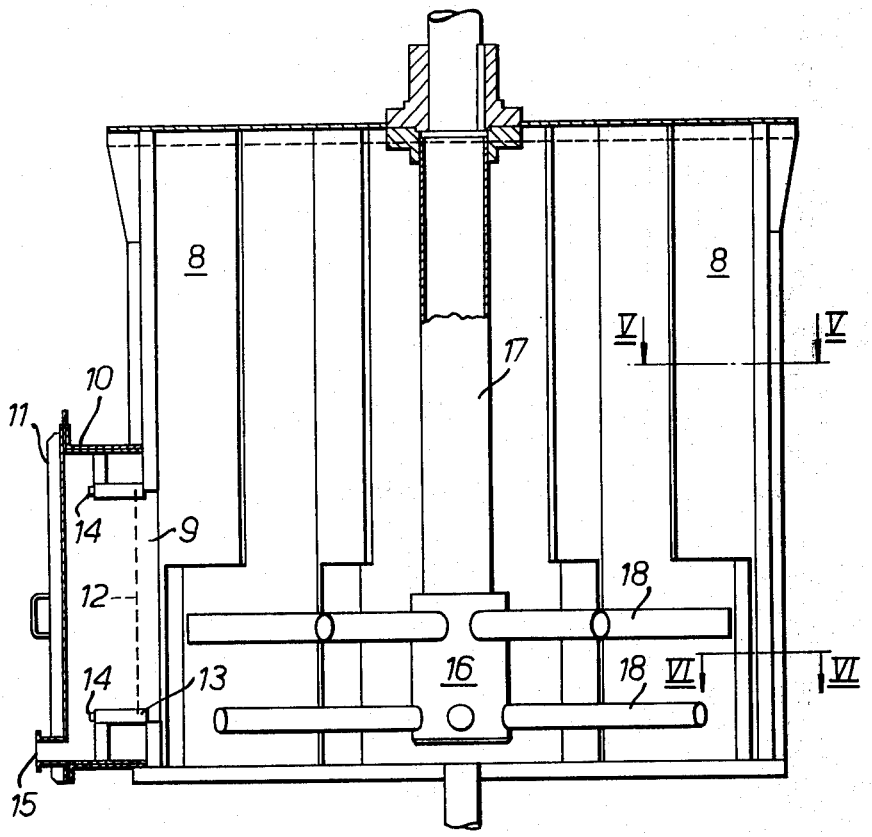
FIG. 4 is a vertical sectional view on lines IV—IV of FIG. 3.
Figure 5:
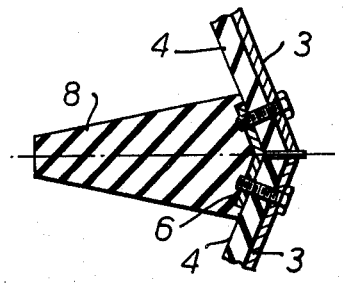
FIG. 5 is a sectional detail on line V—V of FIG. 4.
Figure 6:
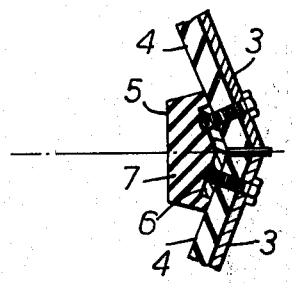
FIG. 6 is a sectional detail on line VI—VI of FIG. 4.

The apparatus comprises an attrition-grinding mill having a grinding chamber 1 of octagonal cross-section which is constructed from flat plates 2 (FIG. 3) bolted together at their edges. Each flat plate 2 comprises a layer of sheet steel 3 to which is bonded a composite member 4 comprising a layer of rubber bonded to a thin steel plate (FIGS. 5 and 6). At each corner there is provided a gusset 5 which comprises a 135° steel angle-bracket 6 bonded to a rubber block 7. The gussets 5 serve to retain the composite members 4 in contact with the steel plates 3. In the upper part of the vessel 1 each rubber block is extended to form a baffle 8 (FIGS. 4 and 5).

A rectangular opening 9 is provided in one of the flat plates 2 and a steel box 10 with a removable front cover 11 surrounds the opening. In the opening 9 there is placed a sieve 12 comprising horizontal bars of conventional wedge-shaped wire which are provided with protuberances at intervals of 35 mm to prevent two adjacent bars from being forced apart by a large particle. The sieve is mounted in a frame 13 which is clamped in place by screws 14. The steel box 10 should preferably be of small volume compared with the volume of the grinding chamber, since when the outlet 15 from the steel box 10 is open the box 10 is only partially filled with ground product slurry and when the outlet 15 is closed by means of valve 34 the ground product slurry will continue to flow through the screen 12 until the box 10 is full with the result that the ratio of granular grinding medium to slurry in the grinding chamber, and thus the load on the electric motor driving the impeller, will continue to rise. The steel box 10 is provided with an outlet 15 at its lowest point to permit the removal of screened, ground product slurry. The outlet 15 from the box 10 is connected to a conduit 31 through which the sieved ground product slurry flows to a product sump 32. The flow of product is controlled by a manual valve 33 and a pneumatically-operated on/off valve 34. An impeller 16 comprises a vertical shaft 17 and twelve round, horizontally-disposed bars 18 the surfaces of which are hardened by means of heat-applied tungsten carbide powder, the bars being arranged symmetrically about the shaft 17 in two layers of six bars. The impeller 16 is driven by an electric motor 19 through a gear box 20. Power for the electric motor 19 is supplied by means of a cable 35. In operation the speed of rotation of the impeller 16 is about 120 rpm, the distance between the diametrically opposite tips of each pair of bars is 1.626 m and the peripheral speed is therefore about 10.2 meters per second. The sieve 12 is at a distance of 115 mm from the tips of the bars.

Feed slurry is fed to the grinding chamber 1 through a chute 21. The slurry is pumped from a sump (not shown) through conduit 22 to a tank 23 which is divided by a partition 24 into two compartments 25 and 26. A valve 27 controls the volume rate of flow of the slurry which is fed initially into compartment 25, any surplus flowing over the partition 24 into compartment 26 and thence through a conduit 28 back to the sump. The slurry flows from compartment 25 to the chute 21 through a conduit 29, the flow rate being controllable by a valve 30. This arrangement ensures that the slurry is always fed under a constant hydrostatic head so that the volume flow rate is substantially constant. Water can be supplied to the grinding chamber 1 by a conduit 39 closed by a valve 40.

Figure 7:
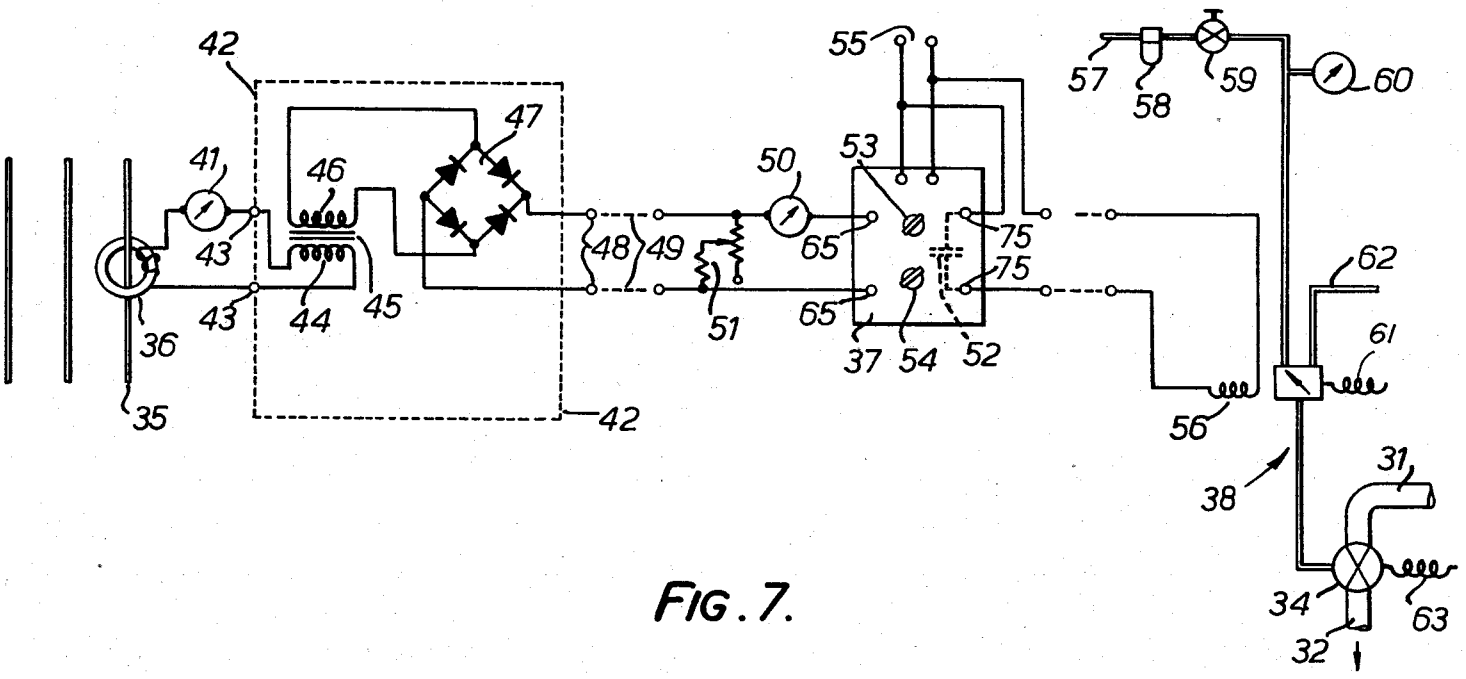
FIGS. 7 and 8 are diagrams showing the control means of the apparatus shown in FIG. 1.
Figure 8:
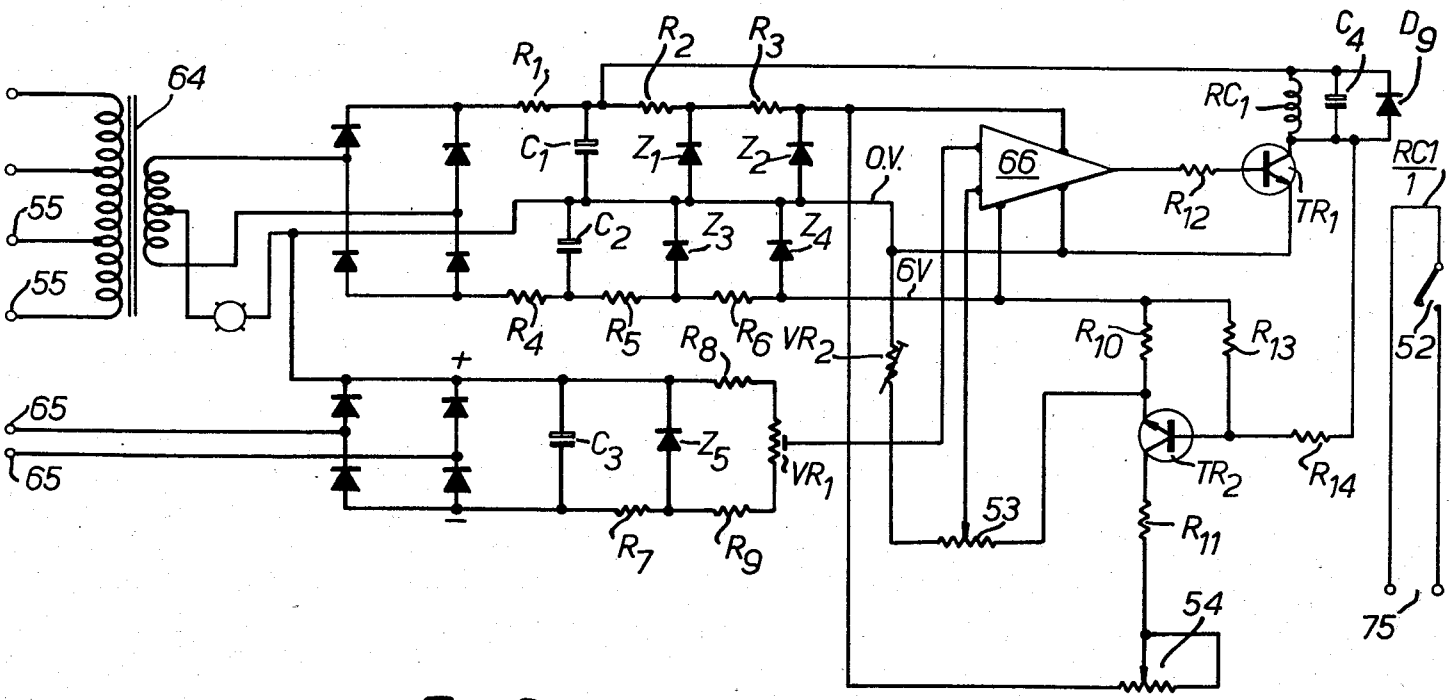

The control means for controlling the flow of ground product slurry are shown in detail in FIGS. 7 and 8. Briefly, a small electric current directly proportional to the electric current flowing in the cable 35 is generated by a current transformer 36. The small current generated by the transformer 36 is fed to an electronic two-step controller 37 with overlap which gives a first signal when the small current rises to a predetermined upper limit and a second signal when the small current falls below a predetermined lower limit. The first and second signals are fed to an electro-pneumatic valve actuator unit 38 which converts the electric signals into pneumatic pulses which cause the valve 34 to close during the supply of the first signal and to open during the supply of the second signal. In more detail, the current transformer 36 which is linked to a line carrying one of the phases of the three-phase supply carried by the cable 35 to the motor 19 converts the current drawn by the motor, which is generally in the range 0–400 amps, to a current in the range 0 to 5 amps. The secondary winding of the current transformer 36 is connected via a 0–5A. ammeter 41 to a current transducer 42, which converts the current of 0 to 5 amps A.C. to a current of 0 to 1 mA.D.C. In the current transducer 42 the 0 to 5 amps A.C. is shown connected at 43 and fed to the primary winding 44 of a current transformer 45. The A.C. flowing in the secondary winding 46 of the transformer 45 is rectified by means of a rectifier bridge 47 and the currrent of 0 to 1 mA.D.C. is taken off at 48. The 0 to 1 mA.D.C. signal is transmitted by a cable 49, which may be up to about 1 KM. in length, to the two-step controller 37 via a 0–1 mA milliammeter 50 which is provided with a network of resistors 51 by which the meter can be calibrated to read directly the current in amps which is being drawn by the electric motor 19. The two-step controller 37 operates a reed relay whose contacts 52 open when the measured current exceeds a predetermined upper limit and close again when the measured current falls below a predetermined lower limit. A potentiometer 53 is provided in the circuit of the two-step controller 37 to enable the upper limit to be adjusted and a potentiometer 54 enables the differential between the upper and lower limits to be adjusted. A 110 volt A.C. power supply is connected at 55. The reed relay contacts 52 are connected to the solenoid 56 of the electro-pneumatic valve actuator unit 38.

Compressed air is supplied to the electro-pneumatic valve actuator unit 38 at a pressure in the range of 50 to 100 pounds per square inch (p.s.i.) ($3.5–7.0 \times 10^5$ $Nm^{-2}$) through a conduit 57 via a filter 58 and a regulator 59. The pressure at which the air is supplied to the valve actuator unit is indicated by a 0 to 30 p.s.i. ($0–2.0 \times 10^5$ $Nm^{-2}$) pressure gauge 60. When the reed relay contacts 52 open, the solenoid 56 is de-energized and the valve core of the actuator unit 38 is returned by a spring 61 to the position which connects the pneumatically-operated on/off valve 34 to atmosphere through a conduit 62. The valve 34 is then closed by means of a spring 63, thus stopping the flow of ground product slurry in the conduit 31.

When the valve 34 is closed no ground product slurry can leave the grinding chamber 1 and the quantity of slurry in the grinding chamber increases, thus reducing the volume ratio of granular grinding medium to slurry the grinding chamber, and as a consequence the magnitude of the current drawn by the motor 19 falls. When the current drawn by the motor 19 falls to the predetermined lower limit the reed relay contacts 52 close, thus energizing the solenoid 56 and moving the core of the actuator unit 38 so that the valve 34 is connected to the compressed air supply. The compressed air supply opens the valve 34 thus restarting the flow of ground product slurry in the conduit 31.

The two-step controller 37 is shown in more detail in FIG. 8. A 110 volt A.C. power supply is connected by terminals 55 to the primary winding of a transformer 65 whose secondary winding feeds a stabilized power supply which gives reference voltages of +12 volts, 0 volts and −6 volts. Each non-zero reference voltage is stabilized by a cascade of two Zener diodes, Z1 and Z2 being used to stabilize the +12 volt potential and Z3 and Z4 the −6 volt potential.

The measured current is connected via terminals 65 to a current routing diode bridge which reverses the polarity if necessary. The Zener diode Z5 is provided to eliminate any surges due to starting of the electric motor or to faults. A voltage proportional to the measured current is developed across a resistance network R8, R9 and VR1, the preset potentiometer VR1 being provided as a sensitivity control. The measured voltage on the slider of VR1 is compared by the integrated circuit voltage comparator 66 with an internally derived upper limit voltage from potentiometer 53.

When the numerical value of the measured voltage is less than the numerical value of the upper limit voltage, but rising, the transistor TR1 is conducting, the reed relay coil RC1 is energized and the reed relay contacts 52 are closed. A small negative potential is applied to the base of the transistor TR2 which is therefore non-conducting. A potential difference of 6 volts is therefore applied across a resistance R10, the upper limit potentiometer 53 and pre-set variable resistor VR2. The potential difference across the potentiometer 53 is therefore about 1 volt. The potentiometer 53 is calibrated to provide upper limit voltages which represent currents in the range 10% to 12% of the normal full load rating of the motor current transformer 36.

When the numerical value of the measured voltage rises to that of the upper limit voltage, the transistor TR1 becomes non-conducting, the reed relay coil RC1 becomes de-energized and the reed relay contacts 52 open, thus closing the pneumatic valve 34 and causing the level in the grinding vessel 1 to rise and the current drawn by the electric motor to fall. At the same time the transistor TR2 becomes conducting since its base is now at a positive potential. Current now flows through a resistance R11 and the potentiometer 54, and the potential difference across the upper limit potentiometer 53 is reduced by an amount dependent upon the setting of the potentiometer 54 thus generating a lower limit. The potentiometer 54 is provided with a dial calibrated to show differentials between the upper and lower limits in the range 5% to 50% of the upper limit voltage.

When the current drawn by motor 19 falls to the level where the numerical value of the measured voltage is equal to that of the lower limit the transistor TR1 becomes conducting, the transistor TR2 non-conducting, the reed relay contacts 52 close, the pneumatic valve 34 opens and the cycle begins again.

In one operation, the granular grinding medium in the form of 2½ tons of Leighton Buzzard silica sand consisting of particles having sizes in the range 0.5 to 1.0 mm was charged to the grinding chamber 1 through the chute 21, and, with the valve 33 fully closed, a feed slurry was charged to the grinding chamber 1 through the valve 30 until the volume ratio of granular grinding medium to feed slurry was 1:1. Rotation of the impeller was then started and the valve 33 was opened until the output flow of ground produce slurry was approximately twice the input flow of feed slurry, the valve 34 being open. As a result the volume ratio of granular grinding medium to slurry slowly rose causing the mixture in the grinding chamber 1 to become more viscous and the electric current drawn by the motor 19 to increase. When the current rose to 170 amps the corresponding rise in the small current generated by current transformer 36 operated the two-step controller 57 and caused the valve 34 to close and discharge of product slurry to stop. As a result, the volume ratio of granular grinding medium to slurry fell again. With valve 34 closed there was no flow through the sieve 12 and therefore no force holding sand particles against the sieve. The sieve was therefore cleaned by the washing action of the tips of the impeller bars agitating the slurry close to the sieve. The valve 34 re-opened when the electric current drawn by the motor 19 fell to 130 amps. The difference between the flow rates through valves 33 and 30 was such that each cycle lasted 5 minutes. During the time for which valve 34 was open there was a tendency for the flow rate of product through this valve to decrease as sand built up on the sieve; this was taken into consideration when valves 30 and 33 were set.

In order to equalize wear on the surfaces of the impeller bars 18, the direction of rotation of the impeller was reversed from time to time, the baffles 8 being symmetrically disposed so that their effect is the same for both directions of rotation of the impeller.

The invention is illustrated further by the following Examples.

EXAMPLE 1

The apparatus and method described above were used to comminute a batch of natural chalk. The chalk was mixed with water containing 0.1% by weight, based on the weight of dry chalk, of a sodium polyacrylate dispersing agent to form a fully deflocculated suspension containing 70% by weight of solids. The suspension was passed continuously through the apparatus described above with reference to the accompanying drawings for a total of 400 hours and the change in particle size distribution and reflectance to visible light was measured by taking samples at four-hourly intervals. Table 2 below gives the mean values of all the samples taken during the run.

Table 2

| | Feed slurry | Product slurry |
|---|---|---|
| % by wt. smaller than 2 μm | 30 | 82 |
| % by wt. larger than 10 μm | 24 | 2 |
| % reflectance to light of 457 nm wavelength | 83.9 | 88.6 |
| % reflectance to light of 574 nm wavelength | 89.3 | 92.1 |
| Energy dissipated in suspension (joules per kg. of dry chalk) | — | $3.28 \times 10^5$ |

EXAMPLE 2

A deflocculated aqueous suspension was prepared by mixing marble which had been ground until all the particles passed through a No. 16 mesh British Standard sieve (nominal aperture 1.0 mm), with water containing 0.3% by weight of a sodium polyacrylate dispersing agent based on the weight of dry marble, the amount of water being such that the proportion by weight of dry marble was 70%. The grinding medium consisted of marble chips having sizes ranging from ¼ inch to ⅜ inch and the mixture was agitated in apparatus as described above, the aperture size of the sieve 12 being ⅛ inch. The ratio of the volume of particles larger than 3.2 mm to the volume of the aqueous suspension of particles smaller than 3.2 mm was maintained within the range of 0.5:1 to 1.5: 1. As grinding proceeded some of the marble chips were abraded and broken until their size was smaller than 3.2 mm and it was necessary to add marble chips of size approximately ½ inch via the chute 21 at a rate such as to just compensate for the loss of the coarser particles by the grinding action. The suspension of finer particles was passed continuously through the same apparatus for a total of 120 hours and the change in particle size distribution was measured by taking samples at 4-hourly intervals. Table 3 below gives the mean values of all the samples taken during the run.

Table 3

| | Feed slurry | Product slurry |
|---|---|---|
| % by wt. smaller than 2 μm | 1 | 28 |
| % by wt. larger than 10 μm | 97 | 48 |
| % by wt. larger than 53 μm | 85 | 1.6 |
| Energy dissipated in suspension (joules per kg. of dry marble smaller than 1 mm.) | — | $1.72 \times 10^5$ |

EXAMPLE 3

A deflocculated aqueous suspension was prepared by mixing marble which had been ground in a ball mill until all the particles passed through a No. 300 mesh British Standard sieve (nominal aperture 53 μm) with water containing 0.3% by weight of a sodium polyacrylate dispersing agent based on the weight of dry marble, the amount of water being such that the proportion by weight of dry marble was 70%. The grinding medium consisted of marble granules having sizes ranging from 0.5 to 1.0 mm and the mixture was agitated in apparatus as described above, the aperture size of the sieve being 0.25 mm. The ratio of the volume of particles larger than 0.25 mm to the volume of the aqueous suspension of particles smaller than 0.25 mm was maintained within the range of 0.5:1 to 1.5:1. As grinding proceeded some of the marble granules were ground down until their size was smaller than 0.25 mm and marble granules of size approximately 1 mm were added via the chute 21 at a rate such as to just compensate for the loss of the coarser particles. The suspension of finer particles was passed continuously through the same apparatus for a total of 120 hours and the change in particle size distribution was measured by taking samples af 4-hourly intervals and screening each sample through a No. 300 mesh British Standard sieve (nominal aperture 53 μm). Table 4 below gives the mean values of all the samples taken during the run.

Table 4

| | Feed slurry | Product slurry |
|---|---|---|
| % by wt. smaller than 2 μm | 21 | 66 |
| % by wt. larger than 10 μm | 40 | 11 |
| Energy dissipated in suspension (joules per kg. of dry marble smaller than 53 μm | — | $7.95 \times 10^5$ |

I claim:

1. An apparatus for use in comminuting particulate solids which apparatus comprises (a) an attrition-grinding mill including a grinding chamber provided with an internal, rotatable impeller for agitating the contents of the grinding chamber, inlet means enabling a feed slurry of a particulate solid to be comminuted to be introduced into the grinding chamber, an outlet means including a sieve for allowing therethrough ground product slurry whilst retaining the granular grinding medium within the grinding chamber, the sieve being disposed at a position such that, when the apparatus is in use, the sieve is below the surface of a mixture of granular grinding medium and slurry in the grinding chamber, (b) first control means associated with at least one of said inlet means and said outlet means of the attrition-grinding mill for controlling the relative volume flow rates of said feed slurry and said ground product slurry, and (c) second control means associated with the outlet means of said attrition-grinding mill and responsive to changes in the volume ratio of granular grinding medium to slurry in the grinding chamber for stopping or starting the flow of ground product slurry through said outlet means.

2. An apparatus as claimed in claim 1, wherein the inner walls of the grinding chamber and those surfaces of the impeller which, in use, contact the contents of the grinding chamber are coated with a resilient material.

3. An apparatus as claimed in claim 2, wherein said resilient material is an elastomer.

4. An apparatus as claimed in claim 1, wherein said impeller comprises a shaft whose axis is substantially parallel to the axis of the grinding chamber and to which there are secured at the end thereof, so as to extend radially outwardly from said shaft, a plurality of bars.

5. An apparatus as claimed in claim 4, wherein the sieve is disposed opposite the bars of the impeller and wherein the distance between the tips of the impeller bars and the sieve is in the range of from 40 to 400 mm.

6. An apparatus as claimed in claim 4 wherein the impeller is connected to a motor capable of rotating the shaft of the impeller at a speed such that the peripheral speed of said bars is in the range 4 to 20 meters per second.

7. An apparatus as claimed in claim 1 wherein said grinding chamber includes a plurality of baffles disposed so as to inhibit the formation of a vortex.

8. An apparatus as claimed in claim 1, wherein said first control means comprises at least one valve provided in a conduit communicating with at least one of said inlet and said outlet means.

9. An apparatus as claimed in claim 8, wherein said first control means comprises a valve provided in a conduit through which feed slurry can be supplied from a tank in which there can be maintained a constant hydrostatic head of said feed slurry.

10. An apparatus as claimed in claim 1. wherein said second control means comprises a valve in said outlet means, sensing means for sensing a change in the ratio of the volume of granular grinding medium and the volume of the slurry in the grinding chamber and for producing a signal which is a function of said change, and actuating means responsive to said signal for operating said valve.

11. An apparatus as claimed in claim 10, wherein said sensing means includes means for sensing a change in the load on said impeller when said apparatus is in operation for producing a first signal when the load on the impeller reaches a predetermined upper limit, said first signal being effective to close said valve, and for producing a second signal when the load on the impeller falls to a predetermined lower limit, said second signal being effective to open said valve.

12. An apparatus as claimed in claim 11, wherein the impeller is connected to electric drive means, by which it is driven, and wherein the sensing means senses the power consumed by said electric drive means.

13. An apparatus as claimed in claim 12, wherein said sensing means senses the current drawn by the electric drive means.

14. A process for comminuting solid particles which process comprises the steps of (a) charging to a grinding chamber of an attrition-grinding mill a quantity of a granular grinding medium and a quantity of a feed slurry of a particulate solid to be comminuted to form a mixture, the quantities of granular grindig medium and feed slurry being such that the volume ratio of granular grinding medium to slurry in the grinding chamber is in the range 0.5:1 to 1.5:1, (b) agitating the mixture of feed slurry and granular grinding medium, (c) admitting further quantities of feed slurry to the grinding chamber whilst withdrawing ground product slurry from the grinding chamber through a sieve provided therein below the surface of said mixture, the relative volume flow rates of feed slurry and ground product slurry being controlled so that the volume ratio of granular grinding medium to slurry in the grinding chamber increases, and (d) interrupting the withdrawal of ground product slurry from the grinding chamber when said volume ratio exceeds a first predetermined value and restoring the withdrawal of ground product slurry when said volume ratio has fallen to a second predetermined value.

15. A process according to claim 14, wherein the granular grinding medium consists of particles ranging in size from 0.15 mm to 20.0 mm.

16. A process according to claim 14, wherein the granular grinding medium consists of a silica sand.

17. A process according to claim 14, wherein the ratio of granular grinding medium to feed slurry in step (a) is such that the ratio of the volumes thereof is in the range 0.9:1 to 1.1:1.

18. A process according to claim 14, wherein the particulate solid to be comminuted consists predominantly of particles smaller than 53 microns.

19. A process according to claim 14, wherein the solid particles to be comminuted consist of a mineral.

20. A process according to claim 19, wherein said mineral is a clay mineral.

21. A process according to claim 19, wherein said mineral is a calcium carbonate mineral.

* * * * *